US007163058B2

(12) United States Patent
Bakke

(10) Patent No.: US 7,163,058 B2
(45) Date of Patent: Jan. 16, 2007

(54) HYDRAULIC JAR DEVICE

(75) Inventor: Stig Bakke, Ålgård (NO)

(73) Assignee: Bakke Technology, AS, Algard (NO)

( * ) Notice: Subject to any disclaimer, the term of this patent is extended or adjusted under 35 U.S.C. 154(b) by 191 days.

(21) Appl. No.: 10/250,850

(22) PCT Filed: Dec. 28, 2001

(86) PCT No.: PCT/NO01/00513

§ 371 (c)(1),
(2), (4) Date: Jul. 3, 2003

(87) PCT Pub. No.: WO02/053868

PCT Pub. Date: Jul. 11, 2002

(65) Prior Publication Data

US 2004/0045716 A1 Mar. 11, 2004

(30) Foreign Application Priority Data

Jan. 5, 2001 (NO) ..... 20010059

(51) Int. Cl.
*E21B 31/113* (2006.01)

(52) U.S. Cl. ..... 166/301; 166/178; 175/296; 175/299

(58) Field of Classification Search ..... 175/296, 175/297, 299; 166/178, 301
See application file for complete search history.

(56) References Cited

U.S. PATENT DOCUMENTS

| | | | | | |
|---|---|---|---|---|---|
| 2,180,223 | A | * | 11/1939 | Collett | 175/297 |
| 2,565,742 | A | * | 8/1951 | Sailers | 166/157 |
| 2,642,140 | A | * | 6/1953 | Brown | 166/327 |
| 2,764,130 | A | * | 9/1956 | Bassinger | 173/67 |
| 2,837,898 | A | * | 6/1958 | Ahlstrand | 417/549 |
| 4,457,379 | A | | 7/1984 | McStravick | 166/373 |
| 4,462,471 | A | * | 7/1984 | Hipp | 175/296 |
| 4,474,234 | A | | 10/1984 | Lefebvre et al. | 166/105 |
| 4,766,960 | A | | 8/1988 | Williamson, Jr. | 166/321 |
| 5,156,223 | A | * | 10/1992 | Hipp | 175/296 |
| 5,168,931 | A | | 12/1992 | Caskey et al. | 166/332 |
| 5,277,260 | A | * | 1/1994 | Ranck | 173/17 |
| 6,062,324 | A | * | 5/2000 | Hipp | 175/296 |
| 6,164,393 | A | * | 12/2000 | Bakke | 175/296 |

FOREIGN PATENT DOCUMENTS

| | | |
|---|---|---|
| NO | 304 199 | 11/1998 |
| SE | 505 171 | 6/1995 |

OTHER PUBLICATIONS

PCT International Search Report dated Apr. 11, 2002, for application No. PCT/NO01/00513.

* cited by examiner

*Primary Examiner*—David Bagnell
*Assistant Examiner*—Shane Bomer
(74) *Attorney, Agent, or Firm*—Patterson & Sheridan, LLP

(57) ABSTRACT

An arrangement by a hydraulic jar device, especially for use in underground wells, where the jar device is installed in a pipe string led down into the well, and designed so that e.g. a stuck object in the well may be loosened or broken up by upward or downward percussions from the jar device. The jar device is actuated by increasing the flow of drill fluid. Alternatively, the device is actuated by compression. A valve (27, 37, 38) closes off the flow of drill fluid, whereby a percussion cycle is initiated. The valve is designed so as also to seal during strong lateral accelerations.

13 Claims, 15 Drawing Sheets

SECTION 2I-2I
FROM FIG. 2

SECTION 2II-2II
FROM FIG. 2

SECTION 8I-8I
FROM FIG. 8a

SECTION 8II-8II
FROM FIG. 8a

SECTION 8III-8III
FROM FIG. 8a

HYDRAULIC JAR DEVICE

CROSS-REFERENCE TO RELATED APPLICATIONS

This application is the National Stage of International Application No. PCT/NO01/00513, filed Dec. 28, 2001 and published under PCT Article 21(2) in English, and claims priority of Norway Application No. 20010059, filed on Jan. 5, 2001. The aforementioned related patent application is herein incorporated by reference.

BACKGROUND OF THE INVENTION

1. Field of the Invention

This invention regards an arrangement by a hydraulic jar device, especially for use in underground wells, where the jar device is installed in a pipe string led down into the well, and designed so that e.g. a stuck object in the well may be loosened or broken up by upward or downward percussions from the jar device, where the jar device comprises a casing member, a connector sleeve, a jar, the casing member and connector sleeve each having separate longitudinal through bores, while the jar has a bore such that hydraulic liquid may pass in the jar device, and where the jar device is provided with a piston associated with a valve designed to close and open a bore during the percussion cycle, the piston valve being designed, respectively, to be closed by the inflow of hydraulic liquid and be opened by a tension spring tensioned during the percussion cycle, when the spring force of the tension spring exceeds the pressure from the inflowing hydraulic liquid, to enable the piston to displace the jar relative to the casing member in order to carry out the percussion.

2. Background of the Related Art

Such jar devices are often used in connection with anchoring of valves, measurement equipment and other equipment downhole. The jar device is provided in a pipe string, e.g. a drill pipe string or coiled tubing, and equipment to be placed in the well is fitted to the lower end of the jar device. As mentioned, the jar device is provided with a passage such that inflowing liquid may pass before the jar device is actuated for percussion. The equipment to be placed in the well may be equipped with grippers, spring bosses or something else that will grip e.g. grooves or seating areas in the wall of the well. In order to ensure that the equipment does not come loose, it is often provided with a locking device to be actuated when at least one shear pin is broken off. In those cases where the pipe string is not able to transfer sufficient force to break off at least one shear pin, it may be broken by means of the jar device. Moreover, the jar device is often used purely as a measure, so that the equipment may be loosened, were it to get stuck.

Such hydraulic jar devices are often pre-tensioned by means of an external spring over the jar device. Alternatively, a long drill string or coiled tubing may constitute the spring element. The percussion is carried out by impact areas on the jar device being moved apart, whereupon the pre-tensioned spring sends the impact areas back towards each other. As mentioned, the jar device comprises a hydraulic piston provided with a passage and an associated valve. The valve is normally open, so that liquid may pass through the piston of the jar device when not actuated for percussion. When the jar device is to be actuated for percussion, increasing the flow rate of the inflowing hydraulic liquid closes the passage, so that the valve is closed at the time in question during the percussion cycle. Alternatively, pushing the jar into the casing member may in one embodiment actuate the device. At this, the piston and also the impact areas of the jar device will be displaced relative to each other during the preparation for the percussion. At the same time, the spring is tensioned further as a result of the movement in the jar device. The piston valve is opened when, during the percussion cycle, the jar device has been brought to the extreme position in question, to allow the liquid to flow through the piston again. The hydraulic force against the piston will then suddenly decrease, and the external, associated spring over the jar device will send the impact areas against each other in order to carry out the percussion, whereupon the percussion cycle is repeated.

The use of a spring that can be pre-tensioned from the outside in order to drive the percussion in the jar device is known. It is further known to design the spring so as to allow it to be pre-tensioned either by pulling the pipe string in the direction away from the jar device or pushing the pipe string in the direction towards the jar device. The magnitude of the impact force may be varied through the pre-tensioning of the spring. When the pre-tensioned spring over the jar device is in a neutral position, hydraulic liquid may be passed through the pipe string without actuating the jar device. The jar device is actuated for percussive movement by a pressure increase in the hydraulic liquid contained in the jar device; this will result in cyclic closing and opening of the piston valve, so that the jar device prepares and performs the percussion in the percussion cycle by displacing the relevant components of the jar device, whereupon the procedure is repeated for new percussions. In one embodiment, the jar device may, as mentioned above, be actuated through the jar being pushed into the casing member.

In many of the known jar devices, see e.g. U.S. Pat. Nos. 4,807,709, 3,570,611, 3,379,261 and 3,361,220, the weight of the equipment hanging from the jar device is often sufficient to actuate the piston valve, so as to close the passage for the hydraulic liquid, thereby actuating the percussion effect. This means that it is not possible to circulate liquid through the pipe string when the jar device is being run into or out of the well. If prolonged circulation is required, the percussion effect may damage the equipment. The hydraulic parts of the jar device such as the piston and valve components, will become worn during operation and therefore require regular replacement. Upon lengthy operation requiring circulation of liquid, parts of the jar device may wear significantly before the jar device comes to be used in the required operations. This may result in a reduced percussion effect and faulty operation. However these are conditions that have essentially been remedied by the jar device according to NO patent 304 199. Here, an efficient, reliable and robust hydraulic jar device of the above-mentioned type has been provided through relatively simple and reasonable means. Furthermore, circulation of liquid such as drill fluid through the jar device is possible without this being actuated upon pre-tensioning of the spring, and it is possible to initiate the percussion effect by increasing the pressure of the inflowing volume of liquid, as the piston valve can not close until there is an increase in pressure in the inflowing liquid.

However the known jar devices, especially jar devices with upward percussions, suffer from a shortcoming in that the impact areas in question are provided on the outside of the jar device. Consequently, the percussion effect may be limited by influences from the outside of the jar device, e.g. by contaminants depositing between the impact areas. Another shortcoming of known jar devices is that the hydraulic liquid can close the piston valve before the impact areas has reached full impact against each other during the final period of the percussion cycle. This means that the liquid over such a prematurely closed piston valve will brake the percussion and give a reduced percussion effect.

SUMMARY OF THE INVENTION

In consequence, one object of the invention is to provide a jar device of the above-mentioned type, where these shortcomings of previous jar devices have been remedied. Another object is to provide a jar device of the simplest and most reliable construction possible. These and any other objects have been realised in the manner that appears from the characterising part of the present independent claim. In accordance with the invention, a piston valve is constructed in a manner such that the sealing body of the valve, which in a preferred embodiment is a ball, is guided via a precise valve guide towards a valve seat where the valve body is supported radially by the valve guide, also in the closed position. The valve is thereby safeguarded against inadvertent opening, e.g. upon the jar device being subjected to great lateral acceleration. A bore in the piston is kept open with clear passage for the hydraulic liquid through the piston, at least until the percussion that during the percussion cycle is triggered by the valve opening, has been completed. Thus the percussion will not be braked by trapped hydraulic liquid and as a result give a reduced percussion effect. Other beneficial features of the invention appear from the claims and the rest of the specification.

BRIEF DESCRIPTION OF THE DRAWINGS

The invention, which exists in two embodiments of which one describes an upward striking jar device and one describes a downward striking jar device, will in the following be explained in greater detail with reference to the drawings, in which.

DETAILED DESCRIPTION OF THE PREFERRED EMBODIMENT

Figure 1:
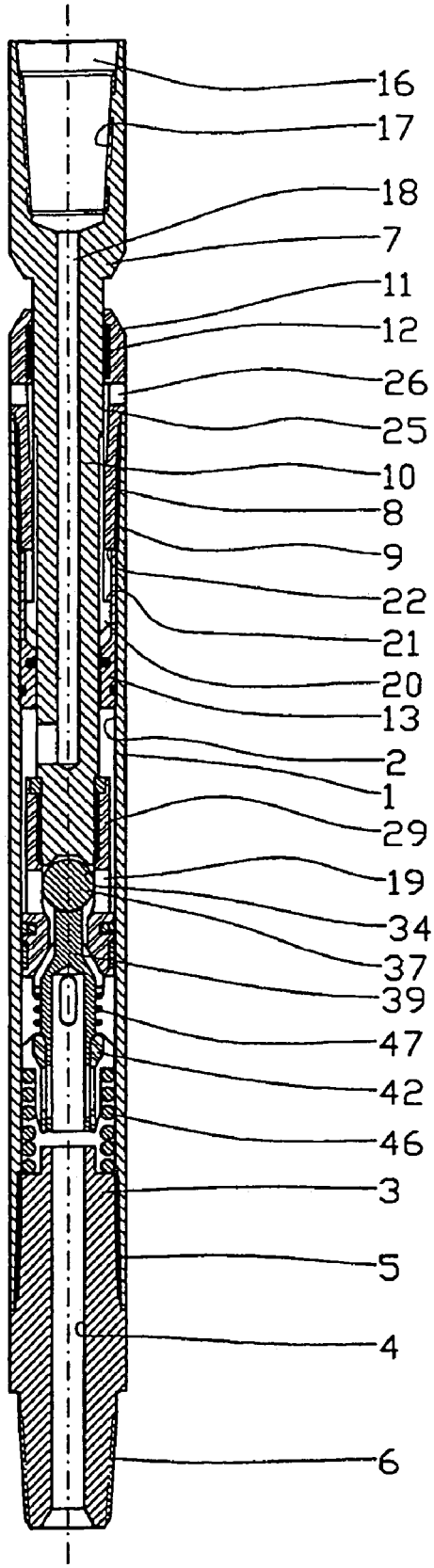
FIG. 1 is a longitudinal section of the present upward striking jar device, comprising a casing member, a lower connector sleeve and a jar, where the lower end of the jar is equipped with a movable piston provided in a longitudinal through bore in the casing member, and which is associated with a valve in the form of a valve ball, an intermediate seating area and a lower valve body, where the jar device is in a non-actuatable position with clear passage for hydraulic liquid through the casing member, the jar and the connector sleeve.

First of all, an embodiment is described with reference to FIGS. 1 to 6, in which the jar device is designed to strike upwards.

The present jar device designed to strike upwards comprises a tubular casing member 1 having a longitudinal through bore 2 so as to allow passage of hydraulic liquid through the casing member 1. The lower end of the casing member 1 is connected to a connector sleeve 3 with a longitudinal through bore 4 for passage of hydraulic liquid. The connection between the casing member 1 and the connector sleeve 3 may for instance be constituted by a threaded connection 5 formed internally of the casing member bore 2, and which is made pressure tight in an appropriate manner. With this, the lower end of the jar device may be coupled to the tool, pipe string etc. (not shown) in question by means of e.g. a lower male threaded connection 6 on the connector sleeve 3.

The upper end of the casing member 1 is such that a jar 7 may be displaced upwards relative to the casing member 1 when the jar device is actuated for percussion effect by an increase in the rate of flow of the inflowing hydraulic liquid. In order to facilitate the axial displacement of the jar 7, the casing member 1 is provided with an axially split end socket 8. The casing member 1 and the end socket 8 are fixed to each other by means of e.g. a threaded connection 9 that is located internally of the upper end of the casing member bore 2, and which is pressure tight. Further, a lower section 10 of the jar 7 is during the percussion cycle movably guided into a longitudinal through bore in the end socket 8. The lower jar section 10 is in sliding abutment against an upper end socket section 11 made pressure tight by an appropriate seal 12 and a lower end socket section 13 made pressure tight by e.g. a compression packing 14, respectively. Furthermore, a seal 15 has been provided to seal against pressure between the casing member bore 2 and the lower end socket section 13.

In addition, the jar 7 has an upper bore 16 provided with a female threaded connection 17, so as to allow the jar device to be coupled to a drill string, coiled tubing etc. (not shown) in a pressure tight manner. The upper jar bore 16 changes into a longitudinal bore 18 that ends up in a vertical gateway 19 at a distance above the lower section 10 of the jar, so that hydraulic liquid may pass through the jar 7 and further out into the casing member bore 2, as shown in FIG. 1.

Furthermore, the jar 7 includes an external, projecting flange-like impact collar 20. With this, the lower, wider section of the impact collar 20 forms an upward facing impact area 21 designed to impact against a downward facing impact area 22 in a midsection of the end socket 8 on the casing member 1. The upward facing impact area 21 on the impact collar 20 is located in an annulus 23 formed by a recess in the end socket 8 between the downward facing end socket impact area 22 and the lower end socket section 13, respectively. The impact collar 20 further has dimensions that allow the lower, wider section of the impact collar 20 to abut the inner wall of the annulus 23 in a sliding manner. As is apparent from FIG. 1, the impact areas 21, 22 on the jar 7 and the end socket 8 are spaced apart when the jar device is in an inactive state.

The impact collar 20 is further provided with at least one vertical passage 24 that extends from the underside of the impact collar 20 and up to an associated passage 25 in the upper section 11 of the end socket. The passage 25 ends in a gateway 26. This means that the hydraulic liquid in the annulus 23 between the lower section 10 of the jar and the end socket 8 has an outlet from the jar device via this at least one passage 24 in the impact collar 20, together with passage 25 and gateway 26 in the end socket 8.

In addition, the jar device comprises a piston 27 that, among other things, makes it possible to move the jar 7 when the jar device has been actuated by an increase in the liquid flow of inflowing hydraulic liquid. The piston 27 is fixed to the lower end of the jar 7 underneath the gateway 19 by the end of the jar bore 18, and this fixing is achieved by e.g. a threaded connection 28. A lower section 29 of the piston 27 is in sliding abutment against the inner wall of the casing member bore 2 during the percussion cycle, and is pressure sealed by e.g. an upper compression packing 30 and a lower, relatively wide seal 31. An upper section of the piston 27 has cross section that is a little smaller than that of the casing member bore 2, so as to allow the formation of an annulus 32 on the outside of and above the upper piston section 27 for the passage of hydraulic liquid. At least one gateway 33 leads from the piston annulus 32 and into a lower bore 34 positioned centrally in the lower section 29 of the piston. The piston bore 34 has an upper section, the valve guide 34', the diameter of which is slightly larger than that of the midsection of the piston bore 34, and the midsection becomes a lower section that slopes out towards a lower piston area 35. The piston has an upper piston area 36, and the upper end of the lower piston section 29 will likewise form an intermediate piston area.

The passage for hydraulic liquid through the piston bore 34 may be shut off by a valve consisting of a (valve) ball 37, an intermediate seating area 38 and a lower valve body 39. The ball 37 is located in an upper section of the piston bore 34, and has approximately the same diameter as the valve guide 34'. The seating area 38 is formed in the transition zone between the upper section and midsection of the piston bore 34. The seating area 38 further has a form that causes the ball 37 to seal against it during the relevant periods of the percussion cycle. The valve body 39 has an upper section that runs into the piston bore 34 and a lower section that runs on the outside of the piston 27, down towards an upper end face 40 of the connector sleeve 3. An upper seating area on the valve body 39 will normally abut the lower side of the valve ball 37. Otherwise, the lower section of the valve body 39 has a cross section that is slightly larger than that of the upper section. The transition zone between these sections of the valve body 39 slopes in a similar manner to the lower section of the piston bore 34, and is provided with upward facing fins 41. The fins 41 on the valve body abut the lower, outward sloping section of the piston bore 34, partly when the jar device is not in the actuated state and partly when the percussion has been triggered following opening of the valve 37, 38, 39 in the piston bore 34, as can be seen from FIGS. 1, 2 and 5.

Figure 2:
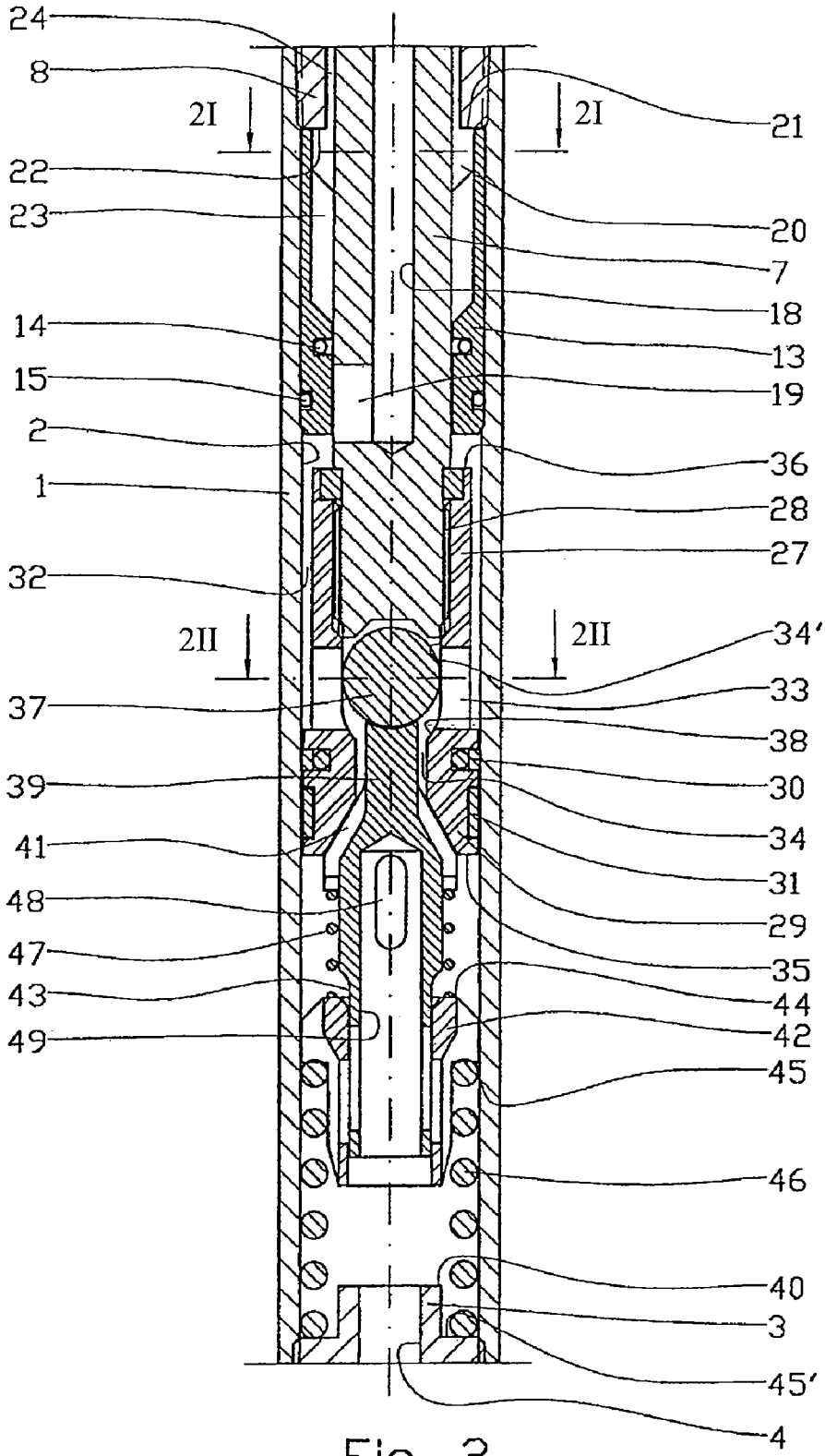
FIG. 2 is a longitudinal section of the midsection of the jar device, on a larger scale, where the impact collar has been brought to a stop against the end socket. In this position, the jar device is ready to commence a percussion cycle, but still has a clear passage for hydraulic liquid through the casing member, the jar and the connector sleeve.

The valve body 39 is equipped with a sliding valve 42 that is movable in a recess 43 at the bottom end of the valve body 39, as shown in FIGS. 1 and 2. Furthermore, the sliding valve 42 is associated with a lower tension spring 46 that is tensioned during the percussion cycle when preparing for the impact between the impact area 21 of impact collar 20 and the impact area 22 of the jar 7, respectively. As can be seen from FIG. 3, the tensioning of the lower tension spring 46 takes place via the valve body 39 when the piston 27 is displaced downwards in the casing member bore 2 during the relevant period of the percussion cycle. Otherwise, the lower tension spring 46 extends between a lower abutment surface 45 on the sliding valve 42 and an outward facing abutment surface 45' in a recess by the upper end of connector 3.

In order to make the valve body 39 retain the ball 37 at an upper limit of travel, clear of the seating area 38, partly when the jar device is not in the actuated state and partly during the relevant periods of the percussion cycle, the valve body is provided with a valve spring 47. The valve spring 47 extends between a lower end face on the fins 41 of the valve body 39 and an upper abutment surface 44 on the sliding valve 42. The valve body 39 further has at least one gateway 48 that enables hydraulic liquid to pass from the casing member bore 2 into a bore 49 in the bottom end of the valve body 39 and then out of this, among other thing to the bore 4 in the connector 3.

The special design of the piston valve 37, 38, 39 ensures that the valve does not inadvertently close off the passage of the piston bore 34 before the impact area 21 of the impact collar 20 has reached full impact against the impact area 22 is of the end socket 8. Consequently, it will not be possible for hydraulic liquid to become trapped on the upper side of the piston 27, as such premature closing would have braked the piston 27 and given a reduced percussion effect during the percussion cycle.

In the following, the principle of operation of the jar device will be explained with reference to the drawings.

In a non-actuated state of the jar device, the impact area 21 of the impact collar 20 is, as shown in FIG. 2, located in the immediate vicinity of the impact area 22 of the jar 7. The valve spring 47 and the valve body 39 further lift the ball 37 off the seating area 38, to leave the piston valve open. With this, hydraulic liquid has a clear passage via the bores, the bore and gateway (19), respectively, of the respective components of the jar device. Furthermore, the jar device is held in this non-actuated state and is also subjected to an upward force from an pre-tensioned spring (not shown) positioned in a suitable location in the pipe string.

Figure 3:
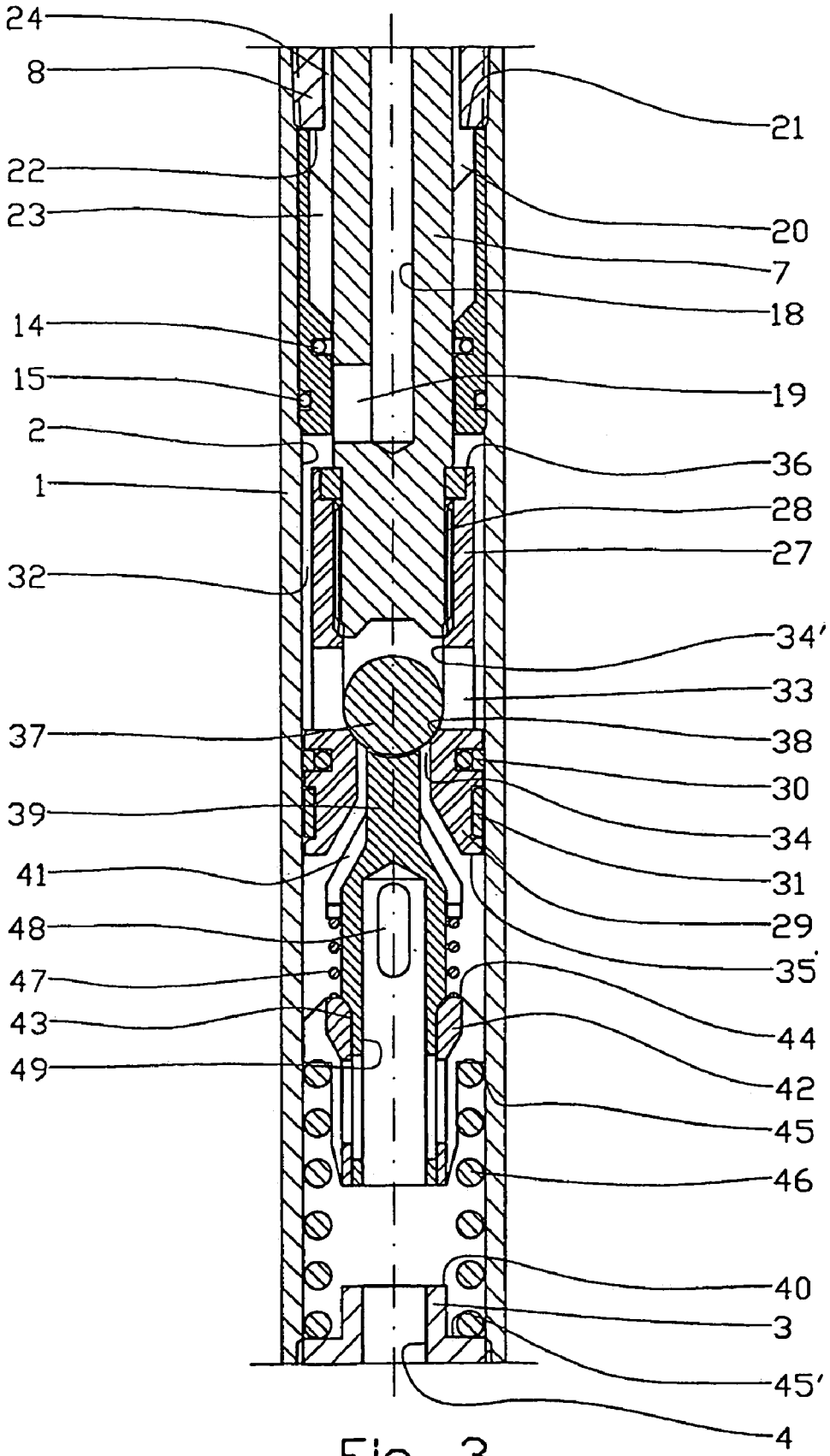
FIG. 3 shows the same longitudinal section, where the valve body is displaced as a result of an increased volumetric flow of liquid, so that the ball closes against the seating area. The liquid pressure against the piston and the ball displaces the piston downwards while the piston tensions a lower tension spring by means of the valve body.
Figure 4:
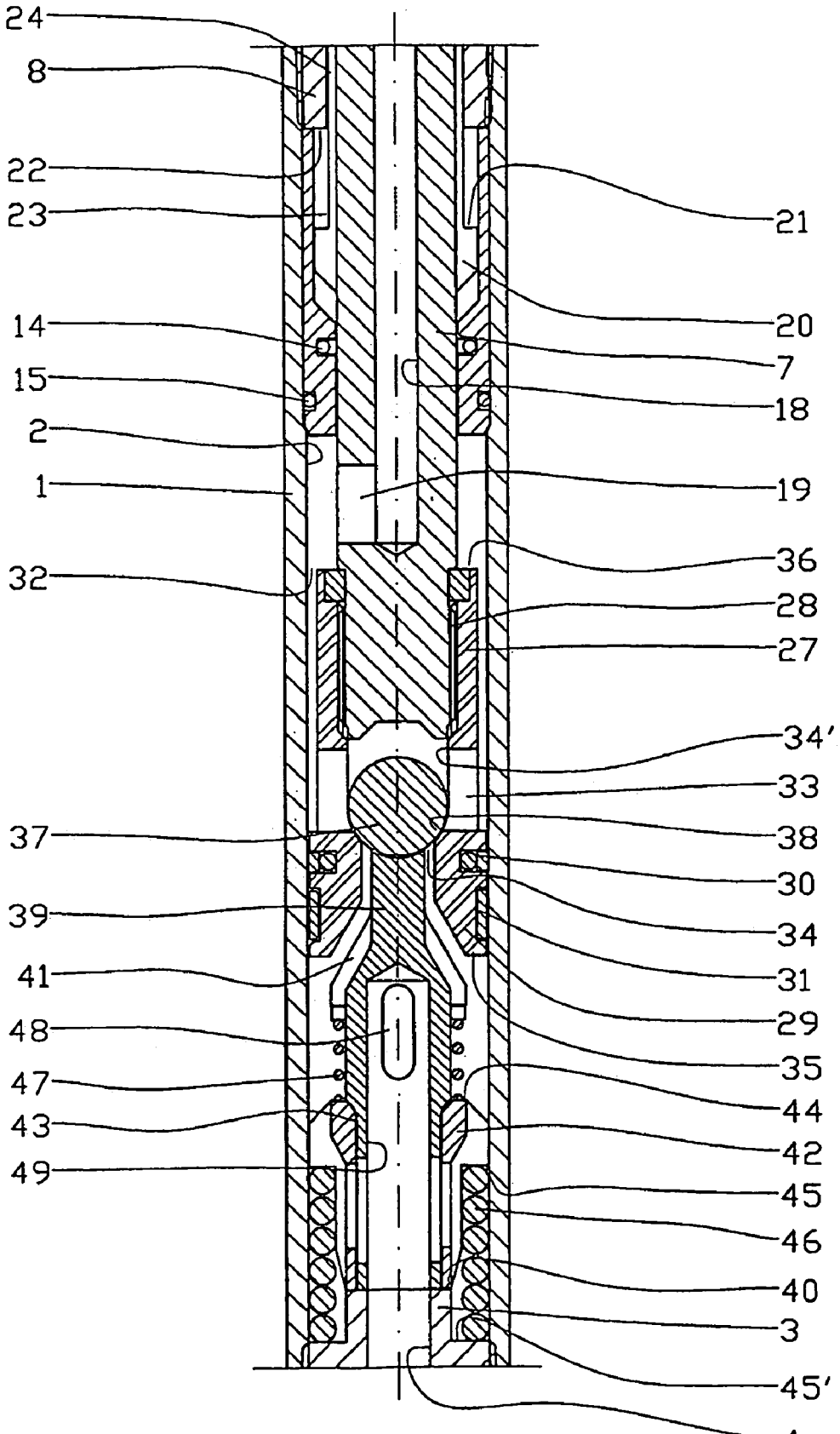
FIG. 4 shows the same longitudinal section, where the piston and the valve body are displaced fully in the tensioning direction as a result of the liquid pressure, so that the valve body abuts the connector sleeve. The liquid pressure against the ball tensions the tension spring by means of the valve body.
Figure 5:
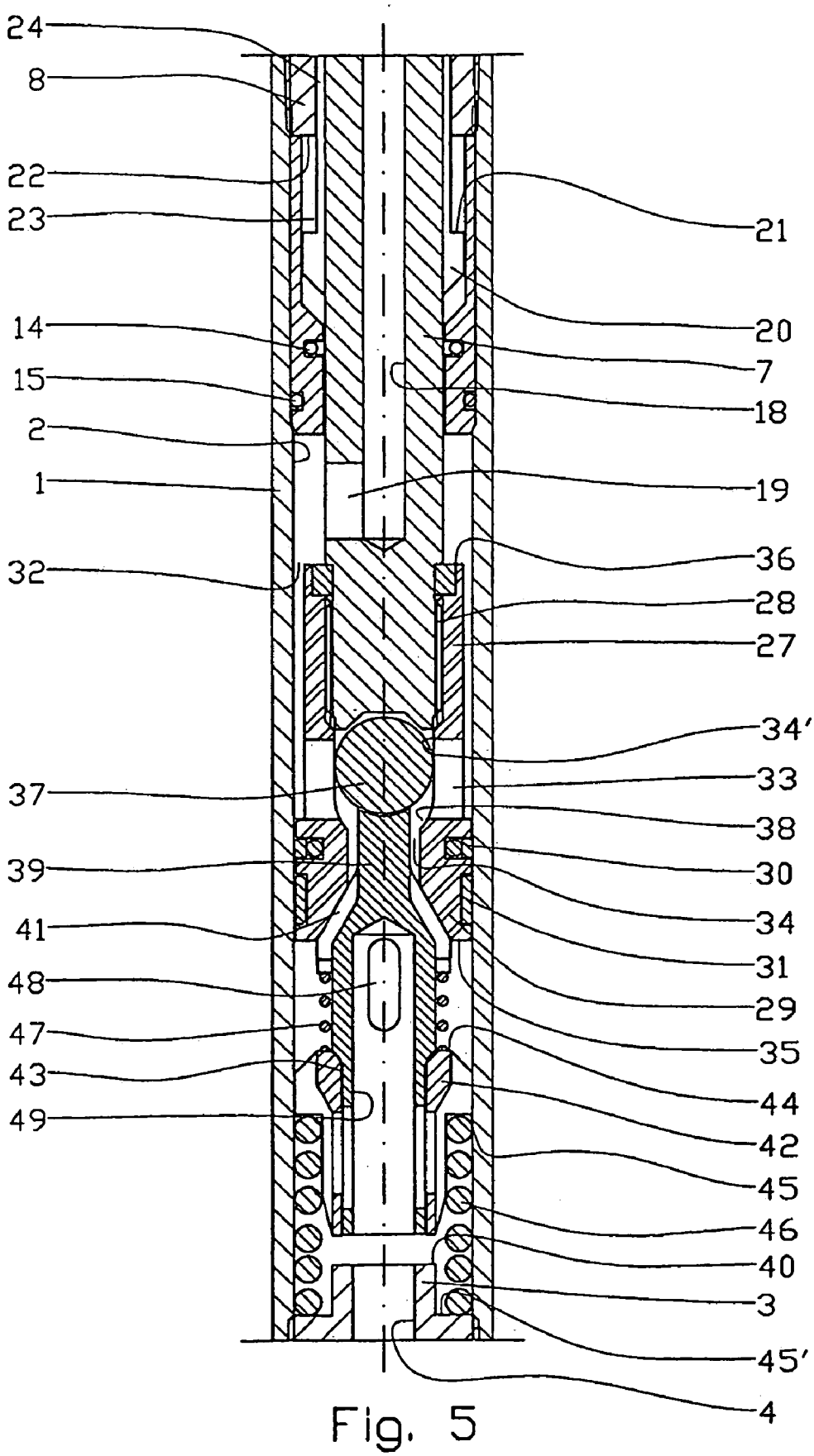
FIG. 5 shows the same longitudinal section, but here the valve ball has been lifted off the seating area to allow liquid to flow through the piston, whereby the jar is free to be displaced in the direction of percussion.
Figure 6:
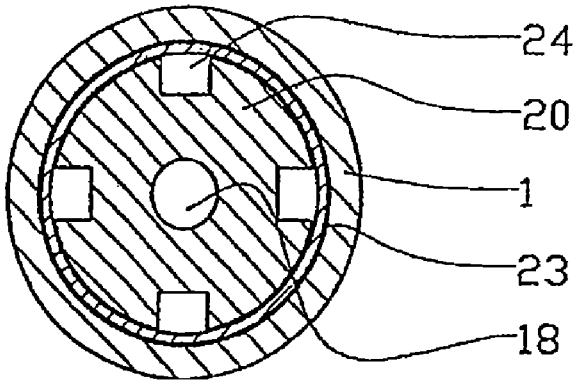
FIG. 6 shows various sections through the jar device at lines A—A, B—B in FIG. 2.
Figure 6:
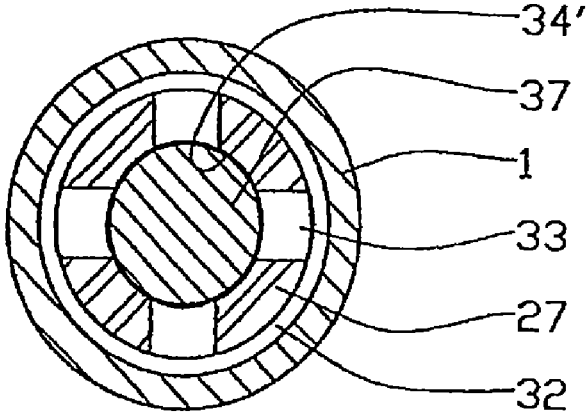

When increasing the flow of hydraulic liquid, the bottom valve body 39 and thereby the ball 37 are displaced downward by the valve spring 47 being compressed, as can be seen from FIG. 3. The ball 37 closes off the passage of liquid through the piston 27 by sealing against the seating area 38. The hydrostatic pressure, which among other things acts on the upper surface 36 of the piston 27 and the ball 37, displaces the piston 27 and the jar 7 to a lower limit of travel just before the percussion is triggered by the opening of the piston valve, see FIG. 4. At this lower limit of travel, the spring tension of the lower tension spring 46 against the sliding valve 42 has reached a value exceeding the pressure from the inflowing hydraulic liquid against the ball 37. Consequently, the spring tension will, via the sliding valve 42 and the valve body 39, displace the ball 37 from the seating area 38 to re-open the valve, see FIG. 5. Alternatively, the piston valve may open when the lower end of the sliding valve 42 abuts the upper end face of the connector 3. By the latter alternative, a continued inflow of liquid will contribute to the valve body 39 lifting the ball 37 off the seating area 38 in order to open the valve.

The pressure drop that results from the opening of the piston valve (37, 38, 39) allows liquid again to flow through the piston bore 34. With this, the spring tension from the tension spring 46 will displace the sliding valve 42 upwards while the valve body 39 displaces the ball 37 off the seating area 38 and the piston 27 upwards in the casing member 1, whereby the spring tension from the pre-tensioned spring (not shown) will be conductive to the impact area 21 of the impact collar 20 being led to impact against the impact area 22 of the end socket 8 by the upper end of the casing member 1.

The piston 27 at the end of the jar 7 and the ball 37 in the piston bore 34 must be provided with piston areas that can cause the piston valve to be closed and opened in the manner intended. Likewise, the spring tension in the valve and tension springs 46, 47 must be selected according to the pressure conditions in the hydraulic liquid being fed to the jar device. In the embodiment shown, the closing and opening of the valve in the piston 27 is controlled by a valve ball 37 and a valve body 39, i.e. two separate parts. These may however be made up from one single part, which will be a combined unit of these with an upper portion adapted to seal against the seating area 38 of the piston bore 34.

The following describes, with reference to FIGS. 7 to 11, an embodiment in which the jar device is designed to strike downwards.

The present jar device for downward percussion comprises a tubular casing member 1 with a longitudinal through bore 2 for allowing hydraulic liquid to pass through the casing member 1. The upper end of the casing member 1 is connected to a connector sleeve 3 in an appropriate manner, e.g. by means of a pressure tight threaded connection 5 formed internally of the bore 2. The upper end of the jar device may thereby in a suitable manner be coupled to a pipe string (not shown), e.g. by means of a pressure tight threaded connection 6 located internally of an upper bore 16 in the upper connector sleeve 3. A lower bore 4 extends further down through the connector sleeve 3 as a continuation of the upper bore 16, to allow hydraulic liquid from the pipe string to pass through the upper connector sleeve 3.

The lower end of the casing member 1 is designed such that the casing member 1 may be displaced externally along a jar 7. The jar 7 has an external impact area 109, preferably extending at right angles to the jar 7 around its entire periphery. Over the impact area 109, the jar 7 has an upper section 110 extending upwards in the casing member bore 2. The external diameter of the upper jar section 110 is considerably smaller than both the external diameter of the jar 7 under the impact area 109 and the diameter of the casing member bore 2. The upper end of the jar section 110 is provided with a sleeve 111 fixed to the upper jar section 110 e.g. by means of a threaded connection 112, so that the area of an upper abutment surface 113 by the upper end of the upper jar section 110 may be increased. The external diameter of the jar sleeve 111 is a little smaller than the diameter of the casing member bore 2, to allow hydraulic liquid to flow past an end face 114 of the jar sleeve 111. The jar 7 and the upper jar section 110 have a longitudinal through bore 18 that allows hydraulic liquid to pass through the jar 7. In addition, the jar 7 is coupled to the relevant tool, pipe string etc. in a pressure tight manner by means of e.g. a lower, male threaded connection 116.

In order to enable the casing member 1 to be displaced along the upper jar section 110, the lower end of the casing member 1 is provided with an end socket 117. The casing member 1 and the end socket 117 are fixed to each other, e.g. by means of a threaded, pressure tight connection 118. Moreover, the end socket 117 is designed to abut the outer periphery of the upper jar section 110 in a sliding manner when the jar 7 is displaced along it during the percussion cycles. The end socket 117 may be provided with internal, longitudinal grooves that are complementary to grooves in the outer periphery of the upper jar section 110, whereby interrotation between the jar 7 and the end socket 117 is prevented. The end socket 117 is made pressure tight against the upper jar section 110 by means of e.g. an upper compression packing 119 and a lower, relatively wide seal 120. Furthermore, the lower end of the end socket 117 is provided with an impact area 121 that is located above the impact area 109 of the jar 7, and which is designed to impact against the impact area 109 of the jar 7 during the percussion cycle of the jar device.

Figure 7A:
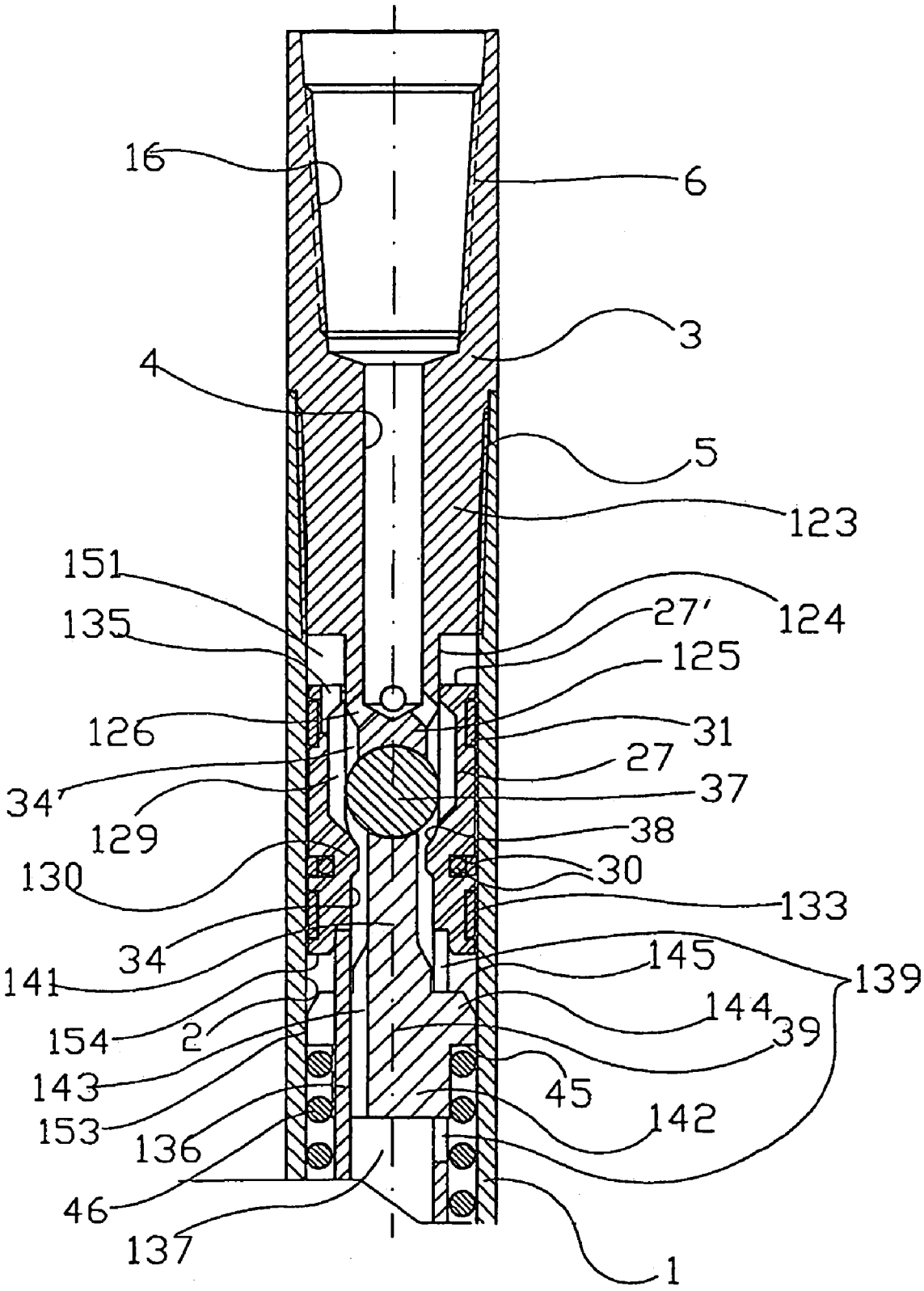
FIGS. 7*a–b* show a longitudinal section of the present downward striking jar device, comprising a casing member, a jar and a connector piece, where the casing member comprises a longitudinal through bore equipped with a movable piston provided in a through piston bore, and which is associated with a valve in the form of a seating area, an upper valve ball and a lower valve body over and under the seating area, respectively, where the jar device is in a non-actuated position with clear passage for hydraulic liquid through the casing member, the jar and the connector sleeve.
Figure 8A:
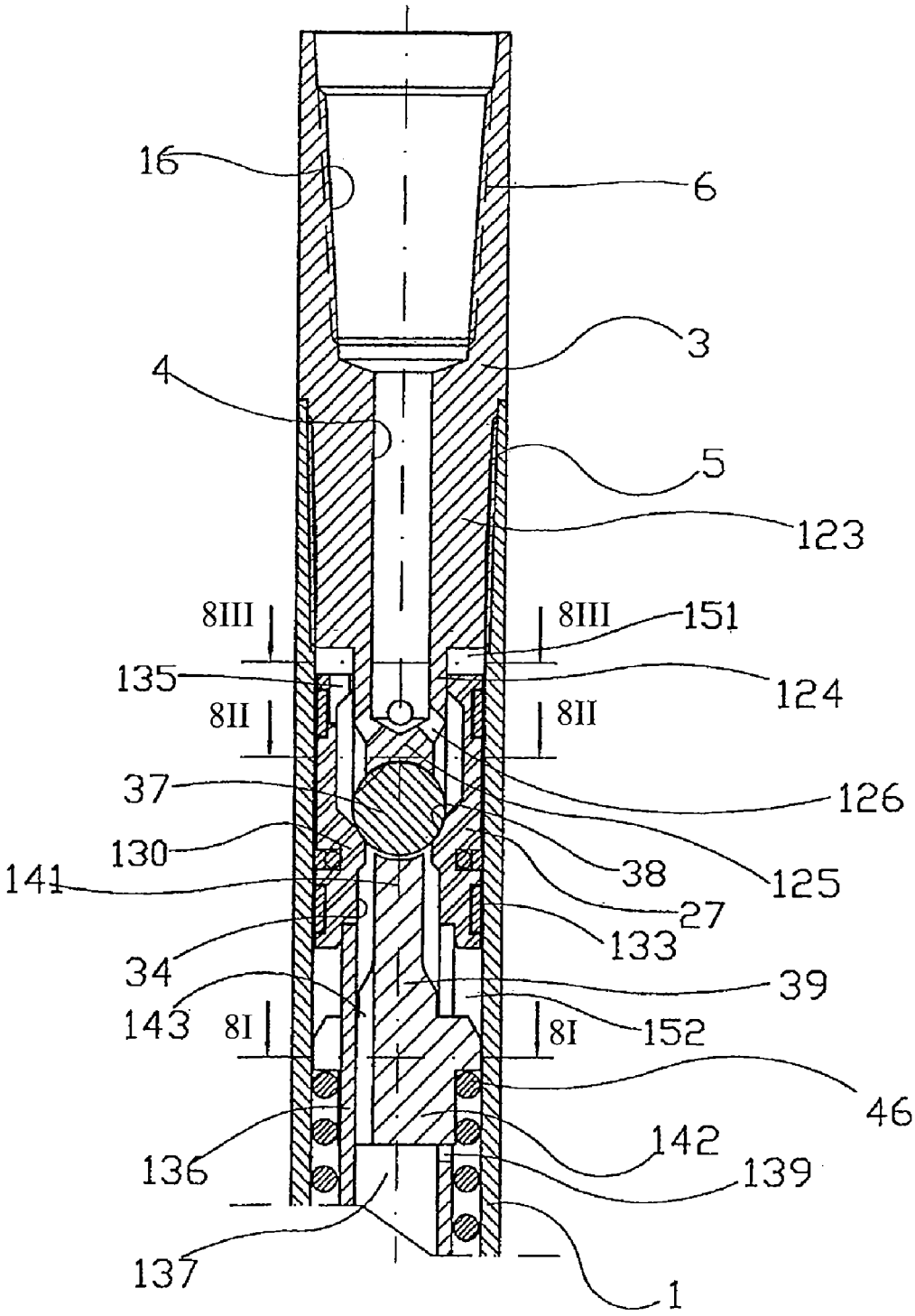
FIGS. 8*a–b* show the same longitudinal sections as FIGS. 7*a–b*, but here the jar device is compressed further, and the piston is moved to a position in the percussion cycle in which the ball is brought into sealing contact against the collar of the piston. Compressed oil is flowing to the upper side of the piston, initiating the downward piston movement.

Below a lower section 123 of the connector sleeve 3, the casing member is equipped with a piston 27 that causes the casing member 1 to be movable up along the upper section 110 of the jar in advance of each single percussion of the jar device. The lower end of the connector section 123 is provided with a recess 124 having a fit such that an upper section of a longitudinal valve guide 34' that, together with a bore 34, constitutes a through bore in the piston 27, may locate in the recess 124, partly when the jar device is not actuated for percussive motion and partly during periods of the percussion cycle, such as shown in FIGS. 7*a* and 8*a*. The lower end of the lower bore of the connector sleeve 3 is fitted with an end piece 125 where hydraulic liquid may pass from bore 4 to at least valve guide 34' via a plurality of orifices 126 running at an angle down through a transition zone between the wall of the recess 124 in the connector sleeve section 123 and the end piece 125.

Figure 10A:
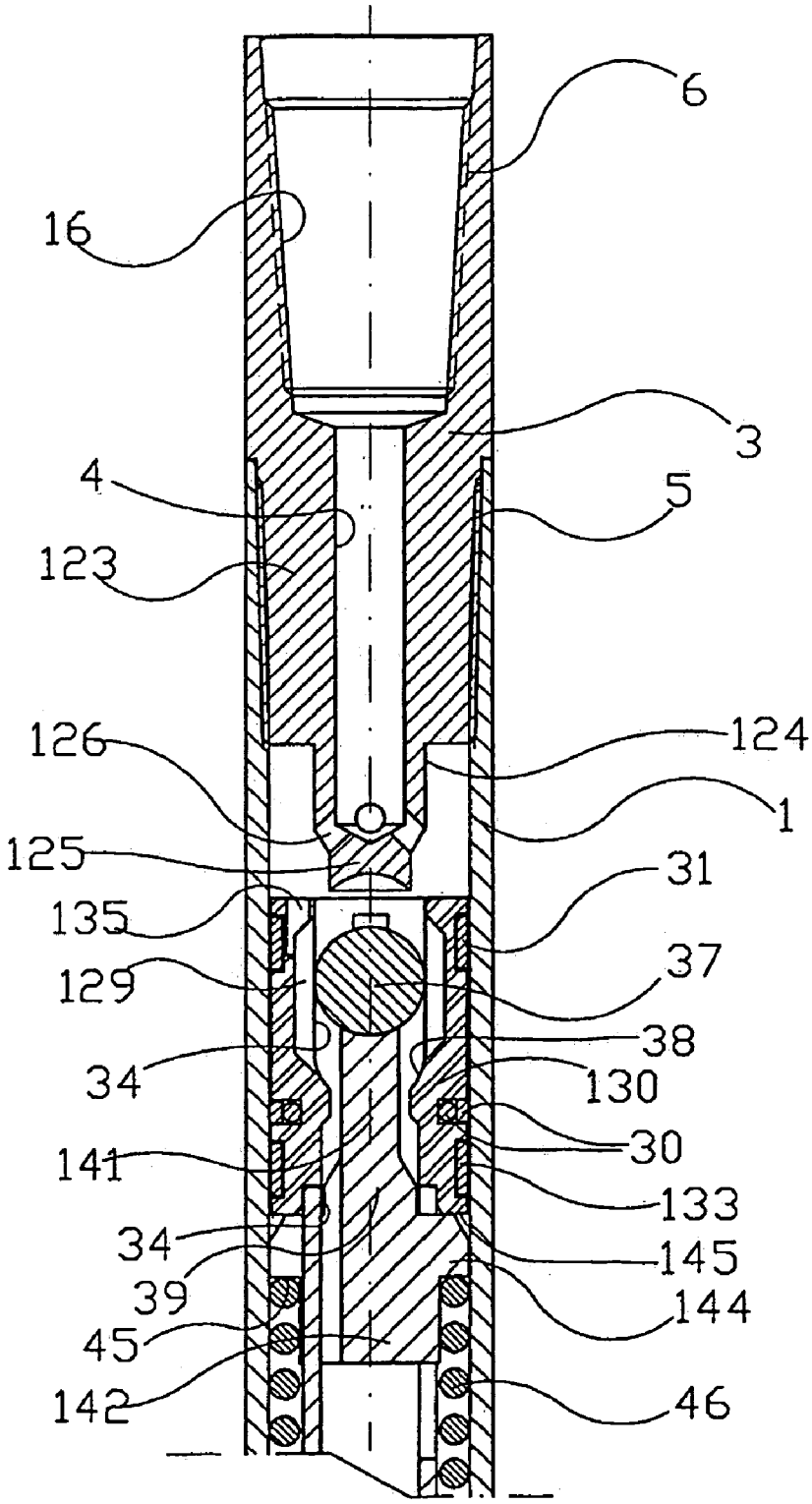
FIGS. 10*a–b* show the same longitudinal section as FIGS. 7*a–b*, but here the percussion has been triggered by the valve body having lifted the valve ball off the seating area as the spring tension in the associated tension spring tensioned during the percussion cycle exceeds the pressure from the inflowing hydraulic liquid.

A midsection of the piston bore 34, 34' is provided with a shoulder 130 projecting into the piston bore 34, 34'. A valve ball 37 is placed in the valve guide 34' above the shoulder 130. The shoulder 130 has an upper seating area 38 that allows the ball 37 to seal against the piston shoulder section 130 in advance of each percussion during the percussion cycle. The seating area 38 of the shoulder 130 and the ball 37 will thereby form a valve that may close and re-open, respectively, the passage for the hydraulic liquid in the piston bore 34, 34' during the respective periods of the percussion cycle. The ball 37 otherwise has a diameter essentially corresponding to the diameter of the valve guide 34', see FIG. 11*b*, whereby is achieved accurate and safe control of the ball 37 towards the seating area 38 during closing. The valve mechanism 37, 34', 38 is relatively insensitive to lateral accelerations. Hydraulic liquid may pass by the ball 37 via a plurality of passages 129 running externally of the valve guide 34' over the shoulder 130, partly when the jar device is not actuated for percussive motion and partly during periods of the percussion cycle, as shown in FIGS. 7*a* and 10*a*. As compared with other types of valve bodies, a ball 37 has a relatively small mass and thereby a low mass moment of inertia. A low mass moment of inertia will, together with the favourable fluid flow resistance of a ball 37, cause the jar device to be able to work at a higher percussion frequency than jar devices according to prior art.

The outside of the piston 27 is designed so as to allow it to slidingly abut the inner wall of the casing member bore 2 during the percussion cycle, and the piston 27 is pressure tight against the casing member bore 2 through a central compression packing 30 and relatively wide, upper and lower seals 31, 133, respectively. Moreover, the piston 27 is provided with at least one upper bore 135 extending essentially vertically down from the upper end face of the piston and further into the passage 129. This at least one bore 135 allows hydraulic liquid to be controlled to an annulus 151 over the top surface 27' of the piston 27, and may allow hydraulic liquid that is undesirably located in the same annulus 151, to escape via the bore 135 and further out through the passages 129 in the piston 27.

The jar device also comprises a displacement piece 136 that extends between the lower end of the piston 27 and the upper abutment surface 113 of the jar section 110 with the associated jar sleeve 111. The displacement piece 136 causes the casing member 1 to be movable up along the jar section 110 when the piston 27 is displaced downwards relative to the casing member 1 in advance of the percussion of each percussion cycle. The displacement piece 136 has an external diameter that is considerably smaller than the diameter of the casing member bore 2, and also a longitudinal through bore 137 for passage of hydraulic liquid through the displacement piece 136. The upper end of the displacement piece 136 has been guided into an enlargement of the lower section of the piston bore 34. The lower end of the displacement piece 136 has an enlarged section 138 abutting the upper abutment surface 113 of the upper jar section 110 and the associated jar sleeve 111.

The upper section of the displacement piece 136 has a plurality of longitudinal elongated slots 139 that allow hydraulic liquid to pass from the bore 137 and out into the annulus 152 between the displacement piece 136 and the casing member bore 2. Further, there is a valve body 39 in the casing member bore 2, associated with the piston 27. An upper section 141 of the valve body 39 has been carried upwards in the piston bore 34. The external diameter of the upper valve body section 141 is a little smaller than the opening through the shoulder 130 of the piston 27, so as not to impede the passage of liquid. The upper end of the valve body section 141 has a seating area that will normally abut the ball 37. Likewise, the lower end of the end piece 125 has, at the outlet of the connector bore 4, a corresponding seating area that may abut the upper side of the ball 37, as shown in FIGS. 7*a* and 8*a*.

Figure 9A:
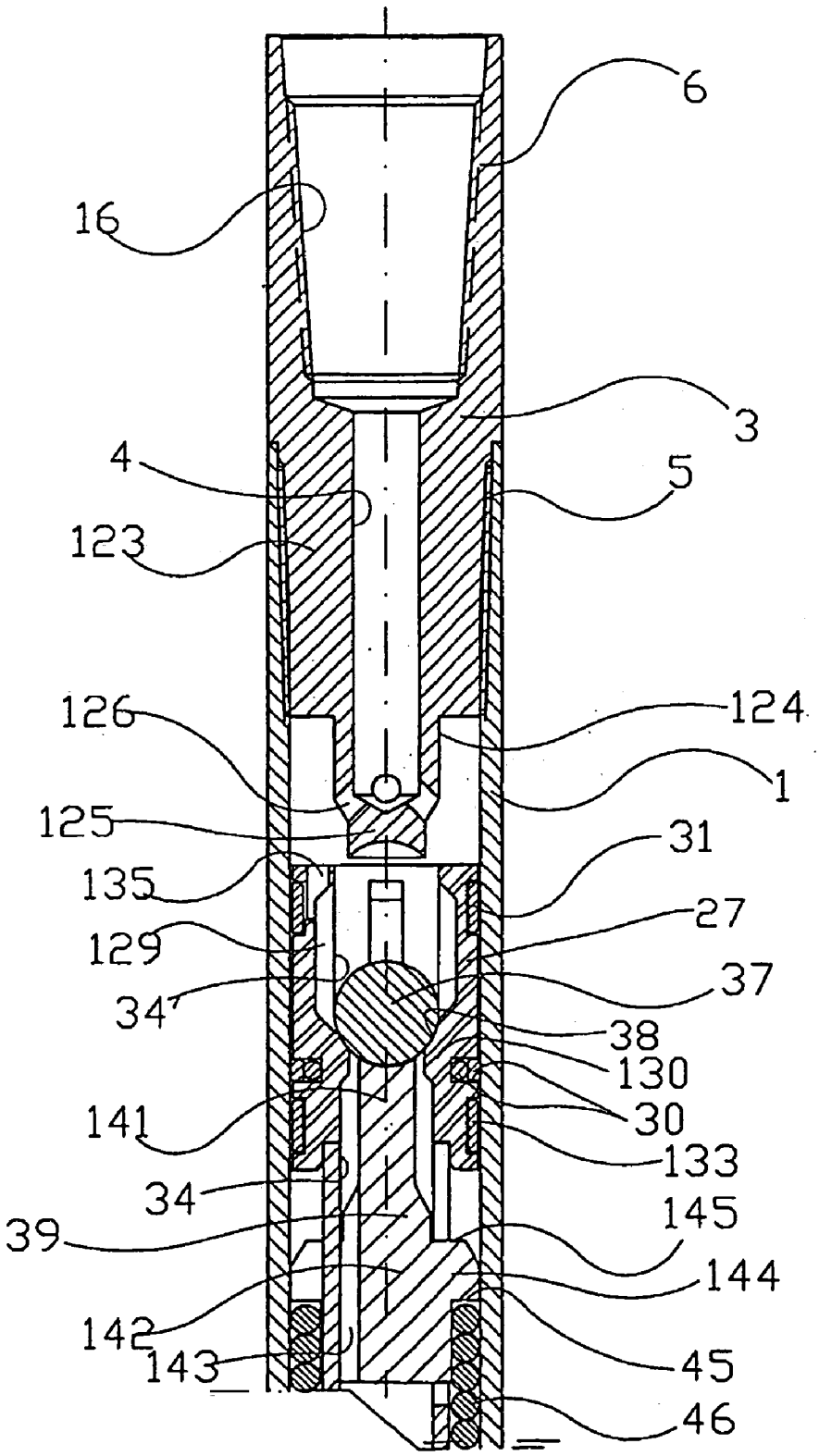
FIGS. 9*a–b* show the same longitudinal section as FIGS. 7*a–b*, but here the piston and valve body have been moved to a lower extreme position during the percussion cycle, while a tension spring associated with the valve body is tensioned, making the jar device ready for a percussion.

A lower section 142 of the valve body 39 extends downwards in the upper end of the bore 137 of the displacement piece 136, and the external diameter of the lower valve body section 142 is formed so as to allow the formation of a passage 143 for the hydraulic liquid between the lower valve body section 142 and the displacement piece 136. The lower valve body section 142 is furthermore equipped with fins 144 carried out through the elongated slots 139 at the upper end of the displacement piece 136. Side faces on the fins 144 of the valve body 39 slidingly abut adjacent faces in the elongated slots 139 of the displacement piece 136, and end faces 153 on the fins 144 slidingly abut the inside wall of the bore 2 of the casing member 1. Consequently, the valve body 39 may be displaced relative to the displacement piece 136 during the percussion cycle, as shown in FIGS. 8*a* and 9*a*. The fins 144 have an upper abutment surface 145 for the lower end face 154 of the piston 27, and a lower abutment surface 45 for a tension spring 46 associated with the valve body 39.

The tension spring 46 enables the valve 39 in the piston 27 to be opened in order to trigger each percussion during the percussion cycle, i.e. by displacing the ball 37 up from the seating area 38 on the piston shoulder 130. The tension spring 46 is positioned in the annulus between the exterior face of the displacement piece 136 and the inside wall of the casing member bore 2. The tension spring 46 further extends between the lower abutment surface 45 on the fins 144 of the valve body 39 and an upper abutment surface 149 on a shoulder 148 that projects into the casing member bore 2 by an area near the place where the upper abutment surface 113 of the jar section 110 with the associated jar sleeve 111 will be when the jar device is not actuated for percussive motion. The bore through the shoulder 148 has a fit that allows hydraulic liquid to flow past it unimpeded in the casing member bore 2. The tension spring 146 is otherwise designed in a manner such that the tension spring 46 will only be compressed in order be tensioned by the valve body 39 when the ball 37 is placed sealingly in the shoulder 130 of the piston 27 and the hydraulic pressure over the ball 37 in the jar device exceeds a predetermined value, while the tension spring 46 will only open the valve in the piston 27 when the tension spring 46 has reached another predetermined higher value that exceeds the hydraulic pressure applied to the jar device.

Selecting an appropriate length for the displacement piece 136 and position for the seating area 38 on the shoulder 130 for the ball 37, as well as the distance between the lower abutment surface 45 on the fins 144 of the valve body 39 and the seating area 38 for the ball 37, can ensure that the valve 37, 38 in the valve guide 34' does not in an undesirable manner close before the impact area 121 of the end socket 117 has reached full impact against the impact area 109 of the jar 7. Thus it is made certain that hydraulic liquid located over the ball 37 during this phase of the percussion cycle is not able to force the ball against the seating area 38 of the shoulder 130 so as to close the valve and trap hydraulic liquid. This avoids such potentially trapped liquid on the underside of the piston 27 braking the piston stroke and giving a reduced percussion effect during the percussion cycle.

In the following, a brief explanation will be given of the principle of operation of the downward striking jar device, with reference to the drawings.

Figure 7B:
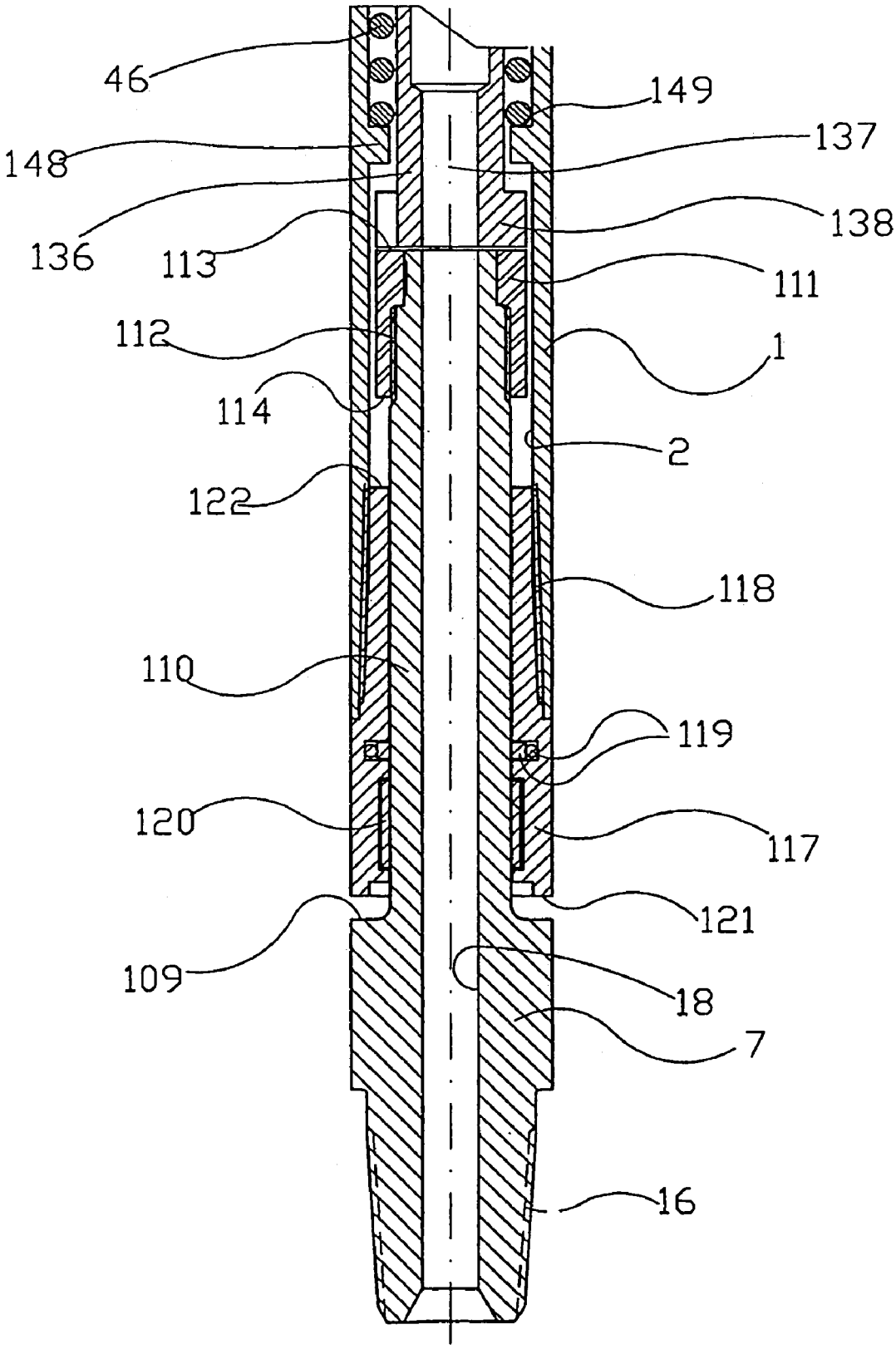

In a non-actuated state of the jar device, the impact area 121 of the end socket 117 is, as shown in FIGS. 7*a* and 7*b*, located a small distance above the impact area 109 of the jar 7. Further, the valve body 39 lifts the ball 37 off the seating area 38 of the shoulder 130, so that the piston valve is open and the ball 37 abuts the seating area of the end piece 125 at the lower end of the connector 3. This leaves a clear passage for hydraulic liquid via the bores and passages of the respective components of the jar device. The jar device is maintained in this non-actuated state by force from at least one pre-tensioned spring (not shown) or similar positioned at a suitable place in the pipe string.

Figure 8B:
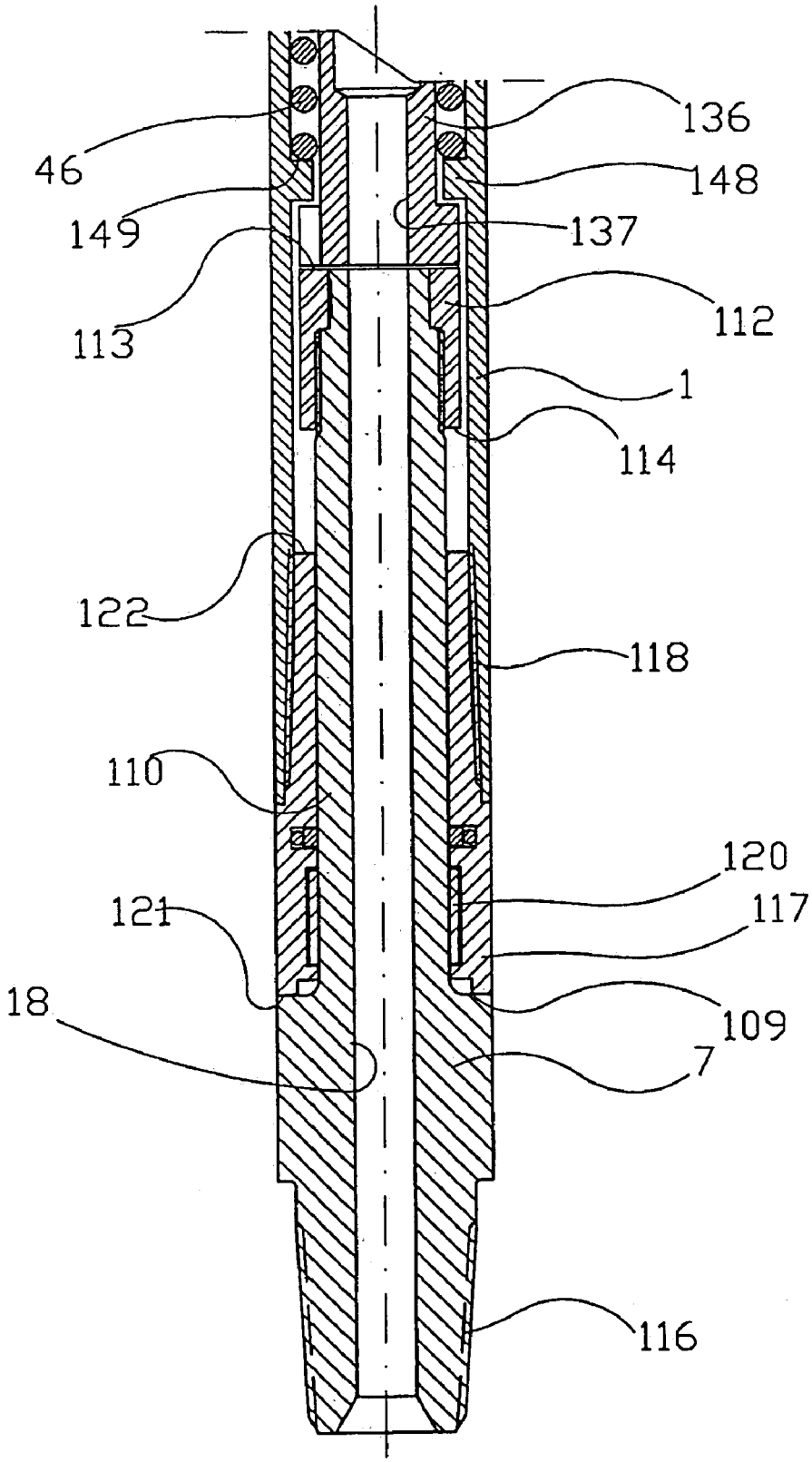

The jar device is actuated by further compression of the tool, see FIG. 8. The lower jar 7 moves the piston 27 upwards in the bore 2 relative to the ball 37 via the displacement piece 136, so that the seating area 38 of the piston seals against the ball 37. The ball 37 will in this phase of the percussion cycle be held in place in the seating area 38 by the end piece 125 of the connector 3. At the same time, the hydrostatic pressure exerts a force against the ball 37 which forces it against the seating area 38 of the piston 27. During this phase of the percussion cycle, liquid flows through the relatively narrow bore 135 to the upper side of the piston 27. By the pressurised liquid filling the annulus 151 relatively slowly, the acceleration of the piston 27 at the starting moment is reduced, so that the ball 37 remains in sealing contact with the seating area 38.

The hydrostatic pressure displaces the piston 27 and the ball 27 downwards in the bore 2 of the casing 1, see FIG. 9, where the piston 27 is at/near its lower limit of travel. At the same time, the valve body 39 under the ball 37 is compressing the tension spring 46, and the jar device is extended by the piston 27 moving the end socket and casing member 1 upwards relative to the jar 7, via the displacement piece 136. This extension will, together with the increase in hydrostatic pressure upstream of the jar device, cause a tensioning of the spring packet above (not shown).

Figure 9B:
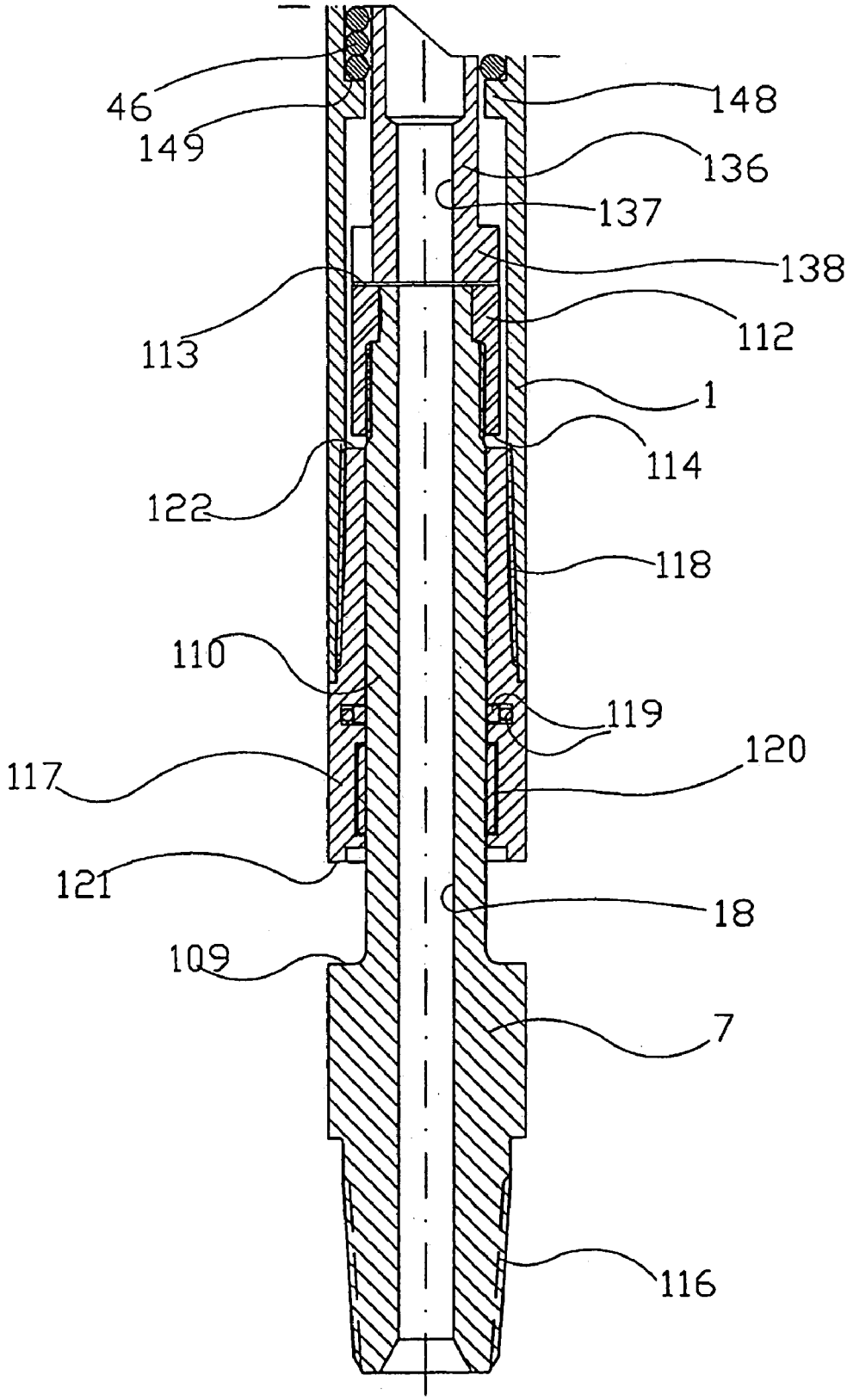

During the further displacement of the piston 27 along with the valve body 39 in the casing member bore 2, the hydrostatic pressure keeps the valve closed until the tension spring 46 reaches a spring tension that exceeds the hydrostatic pressure, as can be seen from FIGS. 9*a* and 9*b*.

Figure 10B:
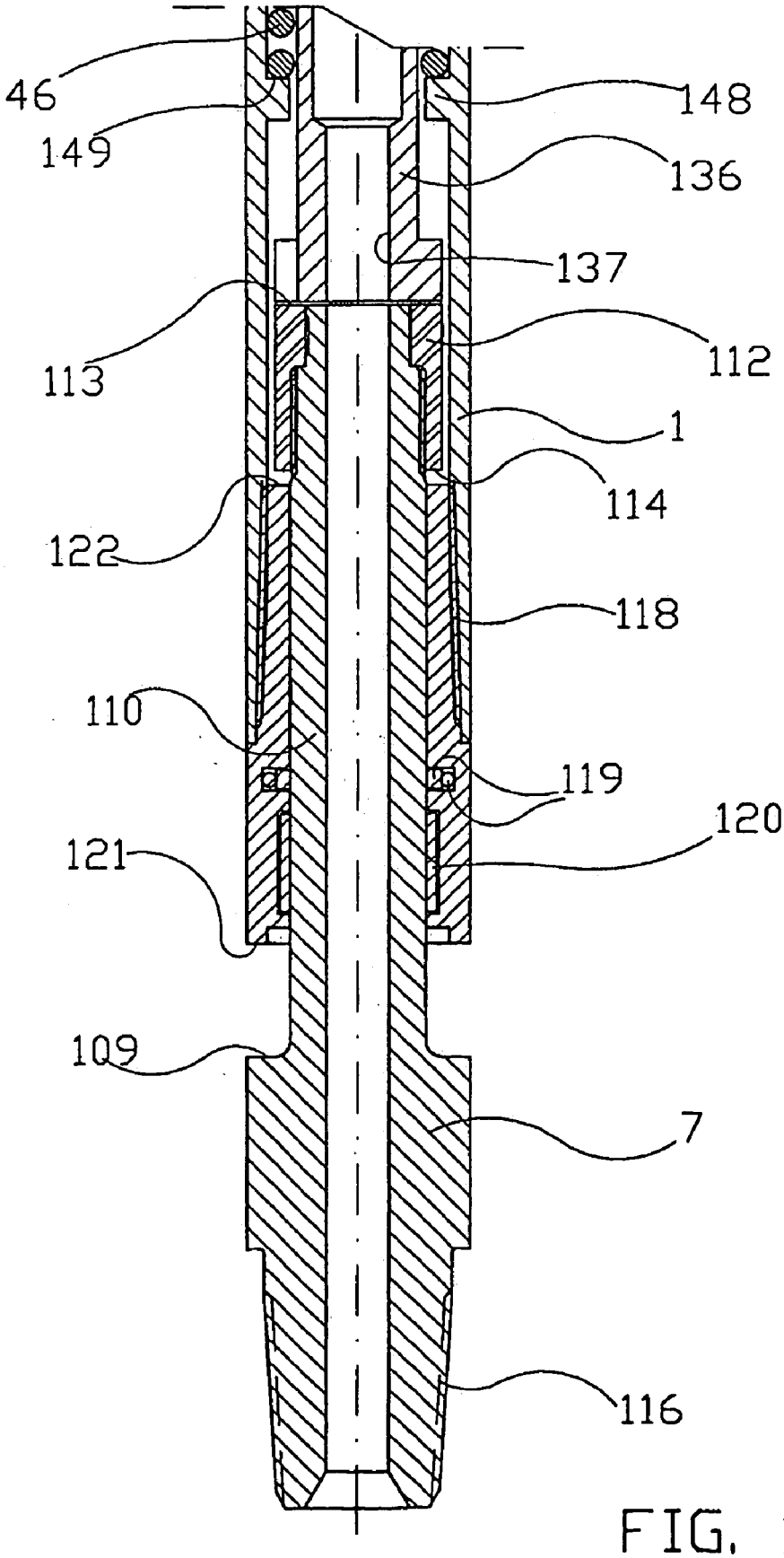
Figure 11A:
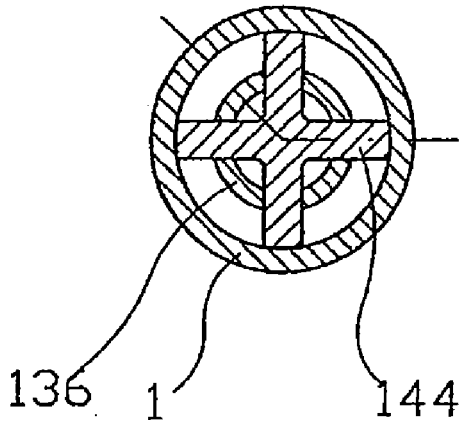
FIGS. 11*a–c* show various sections through the jar device at is the cutting lines A—A, B—B and C—C in FIGS. 8*a–b*.
Figure 11B:
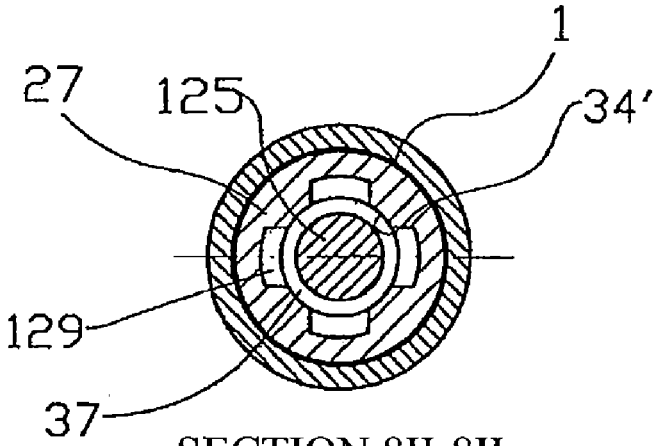
Figure 11C:
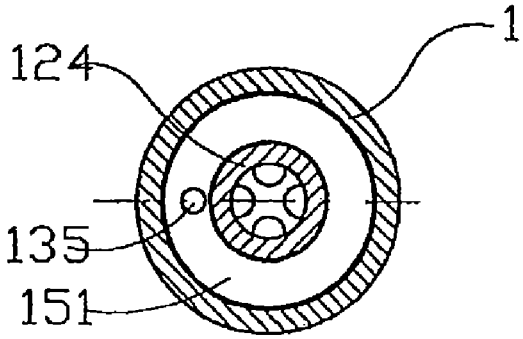

When this spring tension is achieved, the tension spring 46 will displace the ball 37 off the seating area 38 on the valve shoulder 130, via the valve body 39, so that the piston valve is re-opened to trigger the percussion, see FIG. 10. Alternatively, the valve body 39 will push the ball 37 off the seat 38 if the tension spring 46 reaches the bottom.

The pressure drop at the opening of the valve in the piston 27 means that the liquid may again flow through piston bore 34. At this, the spring tension in the tension spring 46 will displace the valve body 39 and the piston 27 abutting the upper abutment surface 145 on the fins 144 of the valve body 39, back into the casing member bore 2. At the same time, the movement of the piston 27 causes the impact area 121 of the end socket 117 to impact on the impact area 109 of the jar 7 by means of the force from the pre-tensioned spring (not shown) in the pipe string.

The length of among other things the displacement piece 136 relative to the seating area 38 for the ball 37 in the piston 27 will furthermore cause the valve in the piston 27 to remain open until the impact area 121 of the end socket has impacted on the impact area 109 of the jar 7. The hydraulic liquid may if required have a possibility of passing through passage 135 at the upper end of the piston 27.

Those skilled in the art will appreciate that the piston 27 in the casing member bore 2 and the ball 37 in the valve guide 34' must be provided with piston areas that cause the piston valve to be closed and opened in the manner intended. Likewise, the spring tension of the tension spring 46 must be selected on the basis of the pressure conditions in the hydraulic liquid flowing into the jar device. In the embodiment shown, a ball 37 and a valve body 39, i.e. two separate parts, control the closing and opening of the valve in the piston 27. These may however be made up of one single part, which will be a combined unit of these with an upper section adapted for sealing against the seating area 38 on the shoulder 130 in the piston bore 34.

During the percussion cycle, there will also be an approximately constant flow of drill fluid through the jar device by the piston 27 being displaced downwards, thus displacing fluid from the underside of the piston 27 during that part of the percussion cycle where the ball 37 shuts off the flow in the piston 27.

The invention claimed is:

1. A hydraulic jar device, for use in underground wells, where the jar device is installed in a pipe string led down into the well, and designed to provide upward or downward percussions from the jar device, where the jar device comprises:

a casing member, a connector sleeve, and a jar, the casing member and connector sleeve each having separate longitudinal through bores, while the jar has a bore and a gateway so that hydraulic liquid may pass in the jar device, and where the jar device is provided with a piston associated with a valve, comprising:

a ball, a valve seat having a curved contact surface, and a lower valve body, designed to close and open a bore during the percussion cycle, the piston valve being designed, respectively, to close off the inflowing hydraulic liquid and to open when the spring force of a tension spring exceeds the pressure from the inflowing hydraulic liquid, so that the piston will displace the jar relative to the casing member, whereby the jar exerts a force against the casing member in order to carry out the percussion, characterized in that a guide is positioned in the immediate vicinity of the valve seat and designed to prevent the ball from movement in the lateral direction of the jar device or when the jar device undergoes a strong lateral acceleration, the guide and the valve seat being made up of surface parts of the same piece of material.

2. The hydraulic jar device according to claim 1, characterized in that the ball is adapted to seal against the valve seat.

3. A method for dislodging a stuck object in a wellbore, comprising;

positioning a downhole tool adjacent the stuck object, the downhole tool comprising:

a body having at least one fluid pathway constructed and arranged to allow fluid to selectively flow therethrough;

a valve body movable between a first position and a second position relative to the body;

a biasing member biasing the valve body in the first position to allow fluid to flow through the at least one fluid pathway; and a movable piston having a valve seat;

a closure member for selective engagement with the valve seat, pumping fluid through the at least one fluid pathway;

urging the closure member into substantial contact with the valve seat and closing the flow of fluid through the at least one fluid pathway;

moving the piston and valve body to the second position by fluid flow, thereby compressing the biasing member;

separating the closure member from the valve seat; and urging the valve body against the piston while returning the valve body to the first position, thereby causing the piston to exert a force against the body for dislodging the stuck object.

4. The method of claim 3, further including preventing lateral movement of the closure member relative to the body.

5. The method of claim 3, further comprising extending the biasing member, thereby returning the valve body to the first position.

6. The method of claim 3, wherein the jar member is moved by the piston.

7. The method of claim 3, wherein urging the closure member into substantial contact with the valve seat comprises compressing a second spring.

8. The method of claim 3, wherein the force of the biasing member is greater than a hydraulic force acting on the piston.

9. The method of clam 3, further comprising providing the jar member with an impact shoulder, the impact shoulder adapted to engage an impact area.

10. The method of claim 9, wherein moving the piston to the second position increases the distance between the impact shoulder and the impact area.

11. The method of claim 10, wherein exerting the force for dislodging comprises engaging the impact shoulder with the impact area.

12. A hydraulic jar device for use in a well, comprising:

a casing member having a longitudinal bore therethrough, a piston disposed within the casing member and adapted to apply a force against the casing member, the piston having a fluid bore;

a valve body for selective engagement with the piston;

a biasing member adapted to move the valve body between a first position and a second position, wherein in the first position, the valve body is urged against the piston and the fluid bore is open, and in the second position, the biasing member is compressed and the fluid bore is closed.

13. The jar of claim 12, wherein the force is applied against the casing member when the valve body moves from the second position to the first position.

* * * * *